US006079402A

United States Patent [19]

Gort et al.

[11] Patent Number: 6,079,402

[45] Date of Patent: Jun. 27, 2000

[54] VENTURI TUBE MOUNTING SYSTEM

[75] Inventors: Thomas L. Gort, Tipp City, Ohio; Carlos R. Tejada Medina, San Luis Potosi, Mexico; Timothy A. Bulcher, Spring Valley, Ohio

[73] Assignee: Whirlpool Corporation, Benton Harbor, Mich.

[21] Appl. No.: 09/330,809

[22] Filed: Jun. 11, 1999

[51] Int. Cl.[7] ..... F24C 3/00

[52] U.S. Cl. ..... 126/39 R; 126/39 B; 431/343; 431/354

[58] Field of Search ..... 126/39 R, 39 E, 126/39 B, 39 N, 50.214 A, 40, 19 R, 38, 39 A, 214 R; 431/354, 343, 350, 355

[56] References Cited

U.S. PATENT DOCUMENTS

| | | | |
|---|---|---|---|
| 3,922,138 | 11/1975 | Biddle et al. | 431/193 |
| 3,982,523 | 9/1976 | Love et al. | 431/354 |
| 4,413,610 | 11/1983 | Berlik | 126/39 |
| 4,572,154 | 2/1986 | Schweitzer | 126/39 |
| 4,971,024 | 11/1990 | Albon et al. | 126/39 B |
| 5,152,276 | 10/1992 | Brock et al. | 126/39 |
| 5,323,759 | 6/1994 | Hammel et al. | 126/39 B |
| 5,464,005 | 11/1995 | Mizrahi | 126/39 R |
| 5,511,973 | 4/1996 | Ray | 431/191 |
| 5,836,296 | 11/1998 | Hillis et al. | 126/39 G |
| 5,851,110 | 12/1998 | Ridenour | 431/278 |

FOREIGN PATENT DOCUMENTS

| | | | |
|---|---|---|---|
| 918564 | 2/1947 | France | 431/343 |
| 127898 | 12/1931 | Germany | 431/343 |
| 353246 | 7/1931 | United Kingdom | 431/343 |
| 691219 | 5/1953 | United Kingdom | 431/343 |

*Primary Examiner*—James C. Yeung
*Attorney, Agent, or Firm*—Andrea Powers-Denklau; Joel M. Van Winkle; Robert O. Rice

[57] ABSTRACT

A venturi tube mounting system having a removable support which supports a venturi tube from a cooktop, prior to assembling of the cooktop, without the need for a burner box and support brackets. The mounting system includes a support device with a first portion engageable to a part of the gas stove cooktop and a second portion engageable to the venturi tube. The support device may have a C-shaped extension at one end for engaging the cooktop and a support element at a second end for supporting the venturi tube. The support can be provided in various forms including a wire-form structure, a clip-type structure, a stamp-formed structure, or similar structures.

19 Claims, 3 Drawing Sheets

FIG. 1
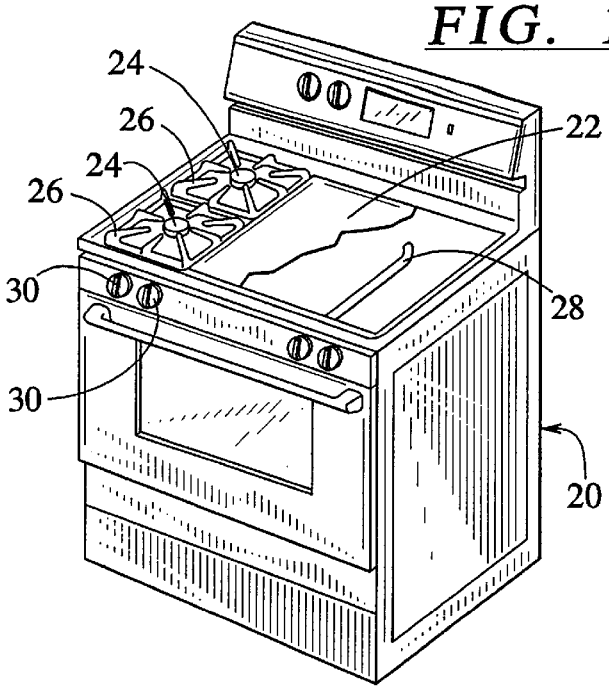
FIG. 4
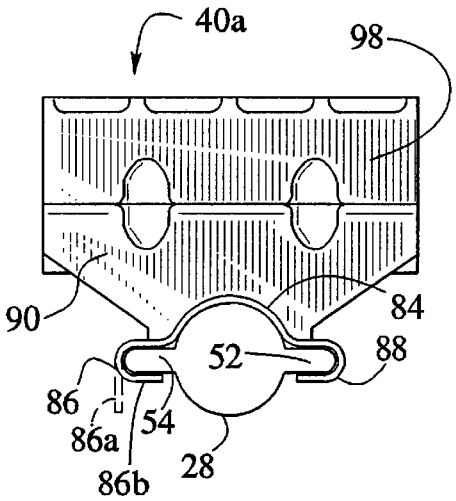
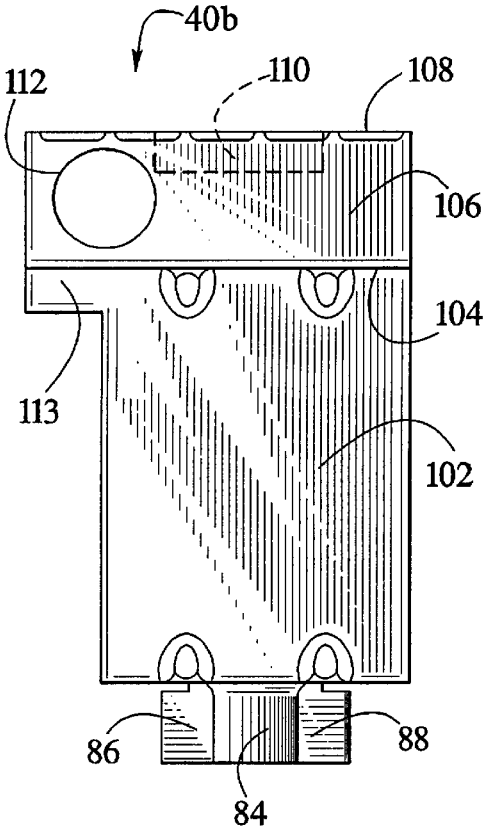
FIG. 8
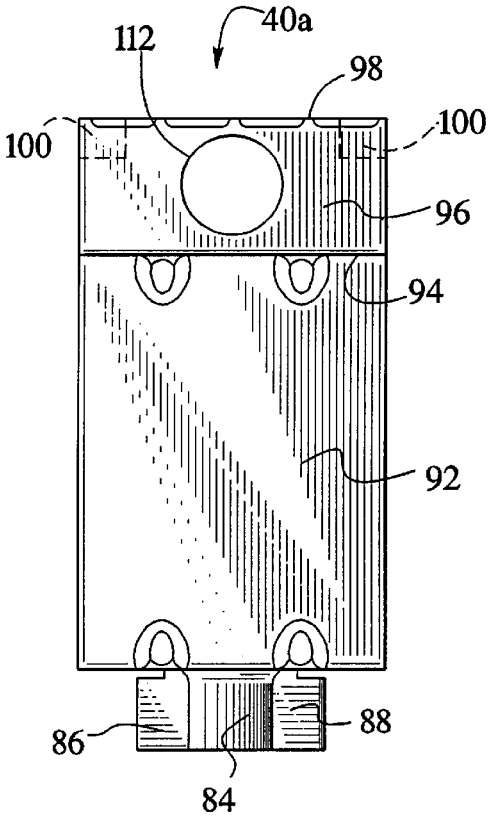
FIG. 5

VENTURI TUBE MOUNTING SYSTEM

BACKGROUND OF THE INVENTION

The present invention generally relates to mounting systems for conventional gas range venturi tubes. Yet more particularly, the invention relates to a system for mounting venturi tubes without the need for a burner box and support brackets.

As is known, conventional ranges include a cooktop having a number of burners supported above an oven. Generally, the cooktop is supported by a burner box mounted above the oven. The burner box is frequently used as a platform for supporting tubing, including venturi tubing, extending from surface valves to surface burners supported on the cooktop surface. A venturi tube is a tube that allows gas to mix with air on a path to a surface burner. One end of the venturi tube slips over an orifice located on the surface valve. The other end of the venturi tube mates to the inside of a surface burner.

In an effort to reduce cost, ranges are being manufactured without burner boxes. This creates a problem regarding the support of the venturi tubing. In these ranges, a frame or cabinet system supports an oven cavity and a cooktop. A manifold tube having a number of gas valves is supported by the frame. The venturi tubes are designed to slip connect to the gas valves and to extend to a number of burner hole openings in the cooktop. Without a burner box, there is no structure to hold the venturi tubes in place prior to assembling the cooktop surface.

In many embodiments, designs of ranges without burner boxes include brackets extending entirely across top frame elements, being supported at opposite ends, for mounting venturi tubes. Alternatively, venturi tubes are attached to the exterior side panels of a range.

SUMMARY OF THE INVENTION

The present application provides an invention directed to venturi tube mounting systems.

To this end, in an embodiment, there is provided a venturi tube mounting system including a support which, at one end, engages a cooktop and, at a second end, supports a venturi tube in place prior to assembling the cooktop, in a cantilever fashion. The support biases the venturi tube upwardly so that an outlet end of the venturi tube extends up through a cooktop opening. The support is designed such that no additional support structure is necessary for supporting the venturi tube prior to assembly of the cooktop. As a result, the present invention provides a system to support venturi tubes without the need for a burner box or large support brackets. Accordingly, the present invention provides for cost effective assembly of a cooktop.

In an embodiment, there is provided a venturi tube mounting system including a support comprised of a wire-form structure. The novel support has a first portion at one end which clasps the venturi tube. The support has a second portion at the other end which engages the cooktop, thus supporting the venturi tube during cooktop assembly.

In an embodiment, there is provided a venturi tube mounting system including a support comprised of a stamped-form structure. The novel support has locking clips at one end which clasp retaining tabs on the venturi tube. The support has a channel at the other end which engages the cooktop, thus supporting the venturi tube during cooktop assembly.

In an embodiment, there is provided a venturi tube mounting system including a support comprised of a clip-type structure. The novel support has a first portion at one end which clasps retaining tabs on the venturi tube. The support has a second portion at the other end which engages the cooktop, thus supporting the venturi tube during cooktop assembly.

An effective method of assembling a surface valve, venturi tube and burner arrangement on a cooktop is thus accommodated. A support for supporting a venturi tube is provided. One end of the venturi tube is slip connected to the surface valve. The venturi tube is attached to the support. The other end of the venturi tube is secured to the burner.

These and other features of the invention will become clearer with reference to the following detailed description of the presently preferred embodiments and accompanying drawings.

BRIEF DESCRIPTION OF THE DRAWINGS

FIG. 1 is a perspective view of a conventional gas range of the present invention with portions removed for clarity.

FIG. 4 is a rear elevational view of the removable support of FIG. 3.

FIG. 5 is a top elevational view of the removable support of FIG. 3.

FIG. 8 is a top elevational view of the removable support of FIG. 7.

DETAILED DESCRIPTION OF THE PRESENTLY PREFERRED EMBODIMENTS

Figure 2:
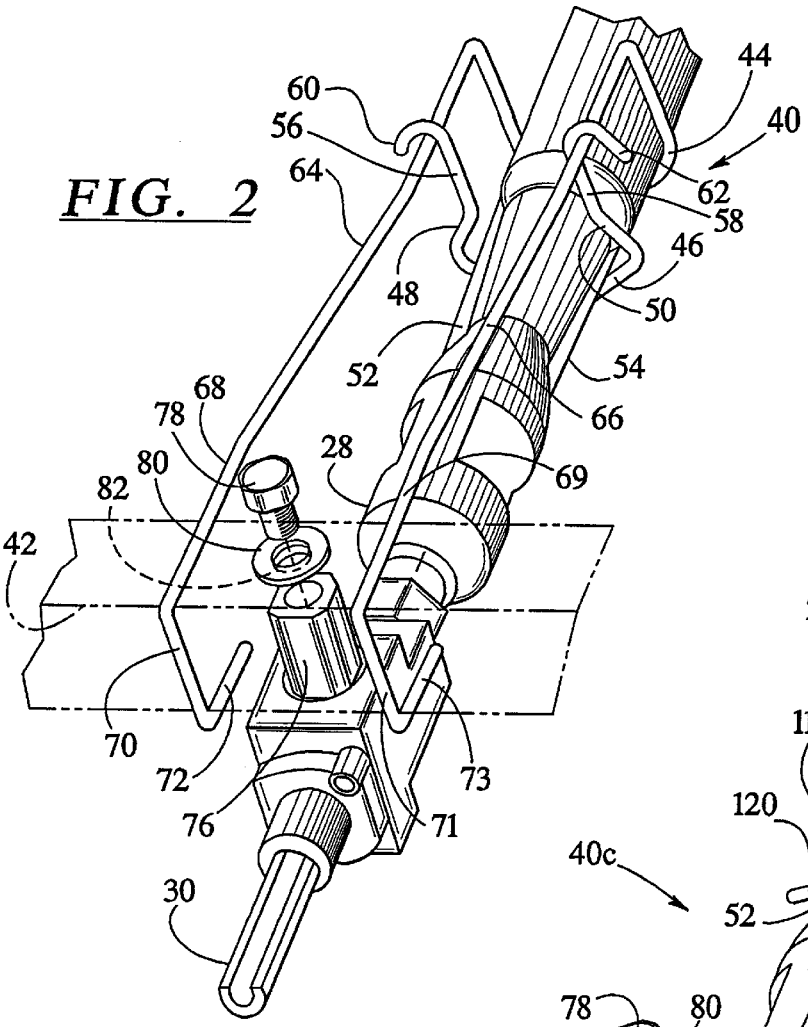
FIG. 2 is a perspective view of a first embodiment of a venturi tube mounting system embodying principles of the present invention.

Typical venturi tube mounting systems provide burner boxes and/or full width support brackets to permanently support venturi tubes in position. In order to reduce cost and improve efficiency of assembly, it is desirable to eliminate the burner boxes and full size support brackets from cooktops.

In this regard, a feature of the invention to that end, is the overcoming of the need to secure venturi tubes to burner boxes and full size support brackets prior to assembly of a cooktop. In an embodiment, the invention inventively solves this problem through a venturi tube mounting system having a cantilever mounted support.

As discussed above, there is provided a venturi tube mounting system including one or more features that, among other things, is particularly useful in supporting venturi tubes without the need for a burner box and full size support brackets, particularly during assembly of the cooktop.

FIG. 1 illustrates a conventional gas stove 20 having a cooktop surface 22 with a number of burners 24 (two shown) surrounded by grills 26. Each burner 24 is connected to a venturi tube 28 which is connected to a source of gas and air, having air mixing openings for providing a gas/air mixture to each burner 24. Each venturi tube 28 is connected to a surface valve 30. During assembly of the conventional gas stove 20, the venturi tube 28 must be connected to the surface valve 30 and the burner 24.

In FIG. 2, there is illustrated a venturi tube mounting system that embodies the principles of the invention. As illustrated, a support 40 engages a manifold tube 42 at one end of the support 40 and supports the venturi tube 28 at the other end of the support 40 during assembly of the venturi tube 28 to the surface valve 30 and burner 24 (FIG. 1). In the illustrated first embodiment, the support 40 has a wire form structure. The support 40 can alternatively embody other structural forms as described below.

The venturi tube 28 sets into a U-shaped portion 44 of the support 40. The support 40 further provides a U-shaped clasp 46, which grips the venturi tube 28 at least partially around a circumference of the venturi tube 28. The U-shaped clasp 46 further has inwardly extending support tabs 48, 50 for engaging retaining tabs 52, 54 of the venturi tube 28. Extending above the support tabs 48, 50 are finger portions 56, 58 having locking tabs 60, 62. The locking tabs 60, 62 clip to first and second leg portions 64, 66, which extend from the U-shaped portion 44. A first extension 68 extending from the first leg portion 64, a second extension 70 bent in from the first extension 68, and a tab 72 bent in from the second extension 70, forming a C-shaped portion, are shown engaging the manifold tube 42 in a secure manner. A first extension 69 extending from the second leg portion 66, a second extension 71 bent in from the first extension 69, and a tab 73 bent in from the second extension 71, forming a C-shaped portion, are also shown engaging the manifold tube 42 in a secure manner. The support 40 can alternatively engage, for example, a manifold panel or a surface valve or other portion of the stove 20.

A surface valve 30 provides a nozzle 76 extending into the manifold tube 42. The nozzle 76 is secured to the manifold tube 42 by a bolt 78 that passes through a washer 80 and a bolt hole 82 in the manifold tube 42 and threadedly engages the nozzle 76.

The embodiment illustrated in FIG. 2 depicts the support 40 engaging a cooktop manifold tube 42 at one end and the venturi tube 28 at the other end. To this end, the venturi tube 28 is exclusively supported by the removable support 40 off the manifold tube 42 and positioned for assembly to the surface valve 30 and burner 24 (FIG. 1).

To assemble the surface valve 30, venturi tube 28, and burner 24 (FIG. 1) arrangement in a cooktop, the support 40 is secured to the manifold tube 42 or other portion of the stove 20. The venturi tube 28 is slip connected to the surface valve 30. The surface valve 30 may or may not already be secured to the manifold tube 42. The surface valve 30 can be secured to the manifold tube 42 by a bolt 78 and washer 80. The venturi tube 28 is set into the U-shaped portion 44. Force is applied to engage the venturi tube 28 into the U-shaped clasp 46, such that support tabs 48, 50 are snapped onto the retaining tabs 52, 54 of the venturi tube 28 resulting in a secure fit between the support 40 and the venturi tube 28 and preventing upward movement of the venturi tube 28. A user inwardly depresses the finger portions 56, 58 to secure the locking tabs 60, 62 to the first and second leg portions 64, 66. The locking tabs 60, 62 prevent downward movement of the venturi tube 28 relative to the removable support 40. Once the venturi tube 28 is engaged by the support 40, the venturi tube 28 is exclusively supported by the support 40 off the manifold tube 42. The venturi tube 28 is then secured to a burner 24 (FIG. 1). The steps identified to assemble the surface valve 30, venturi tube 28, and burner 24 (FIG. 1) arrangement are interchangeable and do not have to be performed in the sequence described above.

Referring to FIGS. 3–8, in alternate second and third embodiments of the invention, a support 40*a* or 40*b* has a stamp-formed structure. The second 40*a* and third 40*b* embodiments of the support are very similar in construction and the same reference numerals are used when referencing identical parts. Letter suffixes are used on reference numerals where parts are similar, but not identical. A clasp 84 sets onto a venturi tube 28 around at least a portion of its circumference. U-Shaped locking clips 86, 88 extending from the clasp 84 engage the retaining tabs 52, 54 on the venturi tube 28 to support the venturi tube 28. In an embodiment, locking clip 86 is provided in an open position as indicated at 86*a* in FIGS. 4 and 7. During assembly, retaining tab 52 of the venturi tube 28 is fit into locking clip 88 of the support 40*a* or 40*b*, retaining tab 54 is positioned against locking clip 86, then locking clip 86 is bent around retaining tab 54 to a closed position to engage the retaining tab 54 to support the venturi tube 28 as shown at 86*b* in FIGS. 4 and 7.

Figure 3:
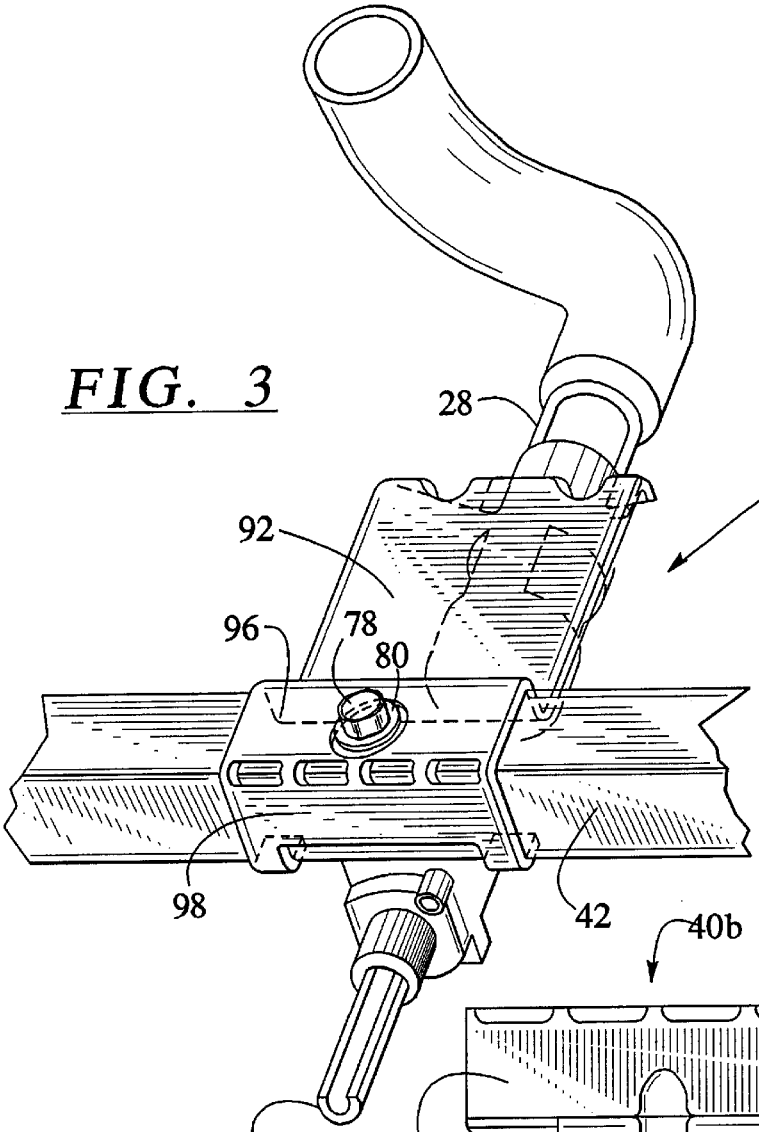
FIG. 3 is a perspective view of a second embodiment of a venturi tube mounting system embodying principles of the present invention.

As best seen in FIG. 3, with respect to the second embodiment, a back portion 90 is bent off from the clasp 84 and a support portion 92 is bent out from the back portion 90. A first extension 94 bent out from the support portion 92, a second extension 96 bent in from the first extension 94, a third extension 98 bent in from the second extension 96, and a tab 100 bent in from the third extension 98 form the C-shaped portion 74 for engaging a portion of the stove 20 to which the support 40*a* can be secured. Similarly, in the third embodiment, support portion 102, first extension 104, third extension 106, and tab 110 form a C-shaped portion 111 for engaging a portion of the stove 20 to which the removable support 40*b* can be secured.

In an embodiment, the support 40*a* or 40*b* is provided with second and third extensions 96, 98 or 106, 108 being in a plane wherein the interface between the second and third extensions 96, 98 or 106, 108 is perforated. During assembly, the bend between the first and second extensions 94, 96 or 104, 106 is positioned against a corner of the manifold tube 42 and the third extension 98 or 108 is bent downwardly at the perforation to form a C-shaped portion 74 around and to engage the manifold tube 42.

The second extension 96 or 106 can be provided with a cut-out 112 to avoid interference with a bolt 78 and washer 80 on the manifold tube 42.

Figure 7:
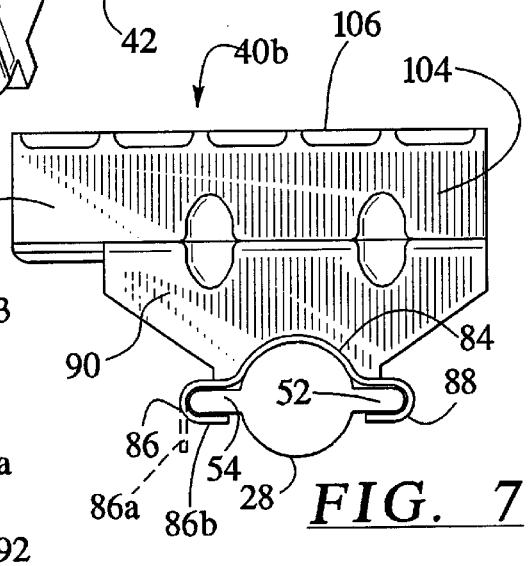
FIG. 7 is a rear elevational view of a third embodiment of a venturi tube mounting system embodying principles of the present invention.
Figure 6:
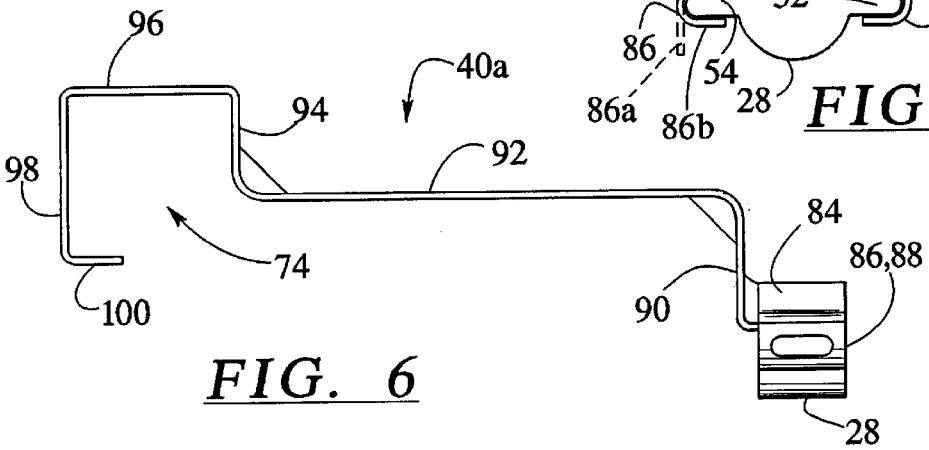
FIG. 6 is a side elevational view of the removable support of FIG. 3.

In the embodiment shown in FIGS. 7 and 8, the first, second, and third extensions 104, 106, 108 and part of the support portion 102 have a width greater than the width of the back portion 90, forming an extension 113. A single tab 110 is bent in from a center of the width of the third extension 108 avoiding interference with the surface valve 30 positioned off center relative to the width of the third extension 108.

In the embodiment shown in FIGS. 4 and 5, the first, second, and third extensions 94, 96, 98 have a width substantially equal to the width of the support portion 92. A tab 100 is bent in from each end of the width of the third extension 98 avoiding interference with the surface valve 30 positioned on center with respect to the width of the third extension 98.

Figure 9:
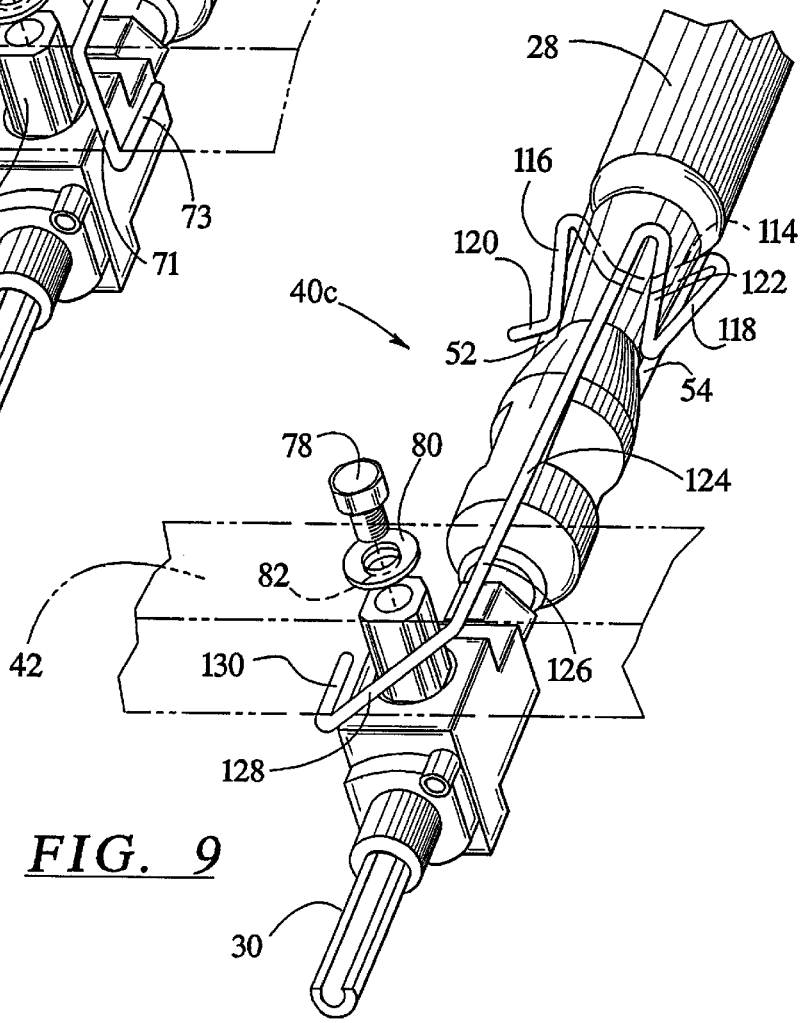
FIG. 9 is a perspective view of a fourth embodiment of a venturi tube mounting system embodying principles of the present invention.

Referring to FIG. 9, in an alternate embodiment of the invention, a support 40*c* has a clip-type structure. The venturi tube 28 sets into a U-shaped clasp 114 at one end of the support 40*c*, which circumferentially grips the venturi tube 28. The U-shaped clasp 114 further has inwardly extending support tabs 116, 118 for engaging retaining tabs 52, 54 of the venturi tube 28. A locking tab 120 is bent off from support tab 116. Extension 122 extends upwardly from support tab 118. A single leg portion 124 is bent off from extension 122. A first extension 126 extending from the single leg portion 124, a second extension 128 bent in from the first extension 126, and a tab 130 bent in from the second extension 128, forming a C-shaped portion, are shown engaging a manifold tube 42 at the other end of the support 40*c* in a secure manner.

The foregoing eliminates the need to secure venturi tubes to burner boxes and full width support brackets prior to assembly of a cooktop by enabling a user to support the venturi tube with a support attached at only one end to the cooktop.

The invention thus provides a mounting device for a venturi tube, to hold the venturi tube between a gas valve and a gas burner on a gas stove cooktop, wherein the device is a member having an elongated body with a first end and a second end. A first portion is formed at the first end and is engageable to a part of the gas stove cooktop. A second portion is formed at the second end and is engageable to the venturi tube. The device is thus arranged to support the venturi tube from the cooktop in a cantilever manner during mounting of the venturi tube to the gas valve and the gas burner. With this invention a cost saving can be effected in the manufacture of a gas stove in that the stove may be manufactured without a separate burner box and with a much smaller supporting element for the venturi tube. Specifically, a gas stove comprising a cooktop having at least one gas burner controlled by a gas valve is provided wherein the burner is supported above an oven cavity without a separate burner box. A venturi tube is supported by a venturi tube mounting system which comprises a support device having a body with a first end and a second end. The first end comprises a first portion engageable to a part of the gas stove cooktop. The second end comprises a second portion engageable to the venturi tube. The mounting device is arranged to support the venturi tube from the cooktop in a cantilever manner during mounting of the venturi tube to the gas valve and the gas burner.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A gas stove comprising a cooktop having at least one gas burner controlled by a gas valve, said burner being supported above an oven cavity without a separate burner box, with a venturi tube, supported by a venturi tube mounting system, extending between said gas valve and said gas burner, said venturi tube mounting system comprising:

a support device having a body with a first end comprising a first portion, engageable to a part of said gas stove cooktop, and a second end comprising a second portion, engageable to said venturi tube, wherein said mounting device is arranged to support said venturi tube from said cooktop in a cantilever manner upon engagement of said first portion to said part of said gas stove cooktop and slip fitting of said venturi tube to said gas valve.

2. The gas stove according to claim 1, wherein said support device comprises a wire-form structure, with said first portion further comprising C-shaped extensions securely engaging a part of said cooktop and said second portion further comprising at least one support tab for resiliently engaging said venturi tube.

3. The gas stove according to claim 2, said support device further comprising two leg portions connecting said first portion to said second portion.

4. A gas stove comprising a cooktop having at least one gas burner controlled by a gas valve, said burner being supported above an oven cavity without a separate burner box, with a venturi tube, supported by a venturi tube mounting system, extending between said gas valve and said gas burner, said venturi tube mounting system comprising:

a support device having a body with a first end comprising a first portion, engageable to a part of said gas stove cooktop, and a second end comprising a second portion, engageable to said venturi tube, wherein said mounting device is arranged to support said venturi tube from said cooktop in a cantilever manner during mounting of said venturi tube to said gas valve and said gas burner, and wherein said support device comprises a clip-type structure, with said first portion further comprising a C-shaped extension securely engaging a part of said cooktop and second portion further comprising at least one support tab for resiliently engaging said venturi tube.

5. The gas stove according to claim 4, further comprising a leg portion connecting said first portion to said second portion.

6. A gas stove comprising a cooktop having at least one gas burner controlled by a gas valve, said burner being supported above an oven cavity without a separate burner box, with a venturi tube, supported by a venturi tube mounting system, extending between said gas valve and said gas burner, said venturi tube mounting system comprising:

a support device having a body with a first end comprising a first portion, engageable to a part of said gas stove cooktop, and a second end comprising a second portion, engageable to said venturi tube, wherein said mounting device is arranged to support said venturi tube from said cooktop in a cantilever manner during mounting of said venturi tube to said gas valve and said gas burner, and wherein said device comprises a stamp-formed structure, with said first portion further comprising a C-shaped extension forming a channel securely engaging a part of said cooktop and second portion further comprising a clasp having at least one locking clip for resiliently engaging said venturi tube.

7. The gas stove according to claim 6, wherein said stamp-formed structure has a body portion and said channel is formed at said body portion by at least one perforation in said body portion forming an area where said body portion is hingedly bendable, wherein said channel engages said cooktop when said channel is hingedly bent at said perforation.

8. The gas stove according to claim 7 wherein said second portion engages a gas manifold adjacent said gas valve, said gas valve being connected to said manifold by a fastener, and said second portion further comprising a cut-out portion enabling said second portion to hingedly bend around a portion of said manifold without interfering with said fastener.

9. A gas stove comprising a cooktop having at least one gas burner controlled by a gas valve, said burner being supported above an oven cavity without a separate burner box, with a venturi tube, supported by a venturi tube mounting system, extending between said gas valve and said gas burner, said venturi tube mounting system comprising:

a support device having a body with a first end comprising a first portion, engageable to a part of said gas stove cooktop, and a second end comprising a second portion, engageable to said venturi tube, wherein said mounting device is arranged to support said venturi tube from said cooktop in a cantilever manner during mounting of said venturi tube to said gas valve and said gas burner, and wherein said support device comprises at least one C-shaped extension at one end for securely and supportingly engaging said cooktop and said second portion further comprises at least one support element adjacent a second end for snugly engaging said venturi tube.

10. A mounting device for a venturi tube, to hold said venturi tube between a gas valve and a gas burner on a gas stove cooktop, said device comprising:

a member having an elongated body with a first end and a second end, a first portion formed at said first end, engageable to a part of said gas stove cooktop, and a second portion formed at said second end, engageable to said venturi tube, wherein said mounting device is arranged to support said venturi tube from said cooktop in a cantilever manner during slip fitting of said venturi tube to said gas valve and during mounting to said gas burner.

11. The venturi tube mounting device according to claim 10, wherein said device comprises a wire-form structure with said first portion further comprising C-shaped extensions and said second portion further comprising at least one support tab for resiliently engaging said venturi tube.

12. The venturi tube mounting device according to claim 11, further comprising two leg portions connecting said first portion to said second portion.

13. A mounting device for a venturi tube, to hold said venturi tube between a gas valve and a gas burner on a gas stove cooktop, said device comprising:

a member having an elongated body with a first end and a second end, a first portion formed at said first end, engageable to a part of said gas stove cooktop, a second portion formed at said second end, engageable to said venturi tube, wherein said mounting device is arranged to support said venturi tube from said cooktop in a cantilever manner during mounting of said venturi tube to said gas valve and said gas burner, and wherein said device comprises a clip-type structure with said first portion further comprising a C-shaped extension and second portion further comprising at least one support tab for resiliently engaging said venturi tube.

14. The venturi tube mounting device according to claim 13, further comprising a leg portion connecting said first portion to said second portion.

15. A mounting device for a venturi tube, to hold said venturi tube between a gas valve and a gas burner on a gas stove cooktop, said device comprising:

a member having an elongated body with a first end and a second end, a first portion formed at said first end, engageable to a part of said gas stove cooktop, a second portion formed at said second end, engageable to said venturi tube, wherein said mounting device is arranged to support said venturi tube from said cooktop in a cantilever manner during mounting of said venturi tube to said gas valve and said gas burner, and wherein said device comprises a stamp-formed structure with said first portion further comprising a channel extending from said body portion and said second portion further comprising a clasp having at least one locking clip for resiliently engaging said venturi tube.

16. The venturi tube mounting device according to claim 15, wherein said stamp-formed structure has a body portion and said channel is formed at said body portion by at least one perforation in said body portion forming an area where said body portion is hingedly bendable, wherein said channel engages said cooktop when said channel is hingedly bent at said perforation.

17. A mounting device for a venturi tube, to hold said venturi tube between a gas valve and a gas burner on a gas stove cooktop, said device comprising:

a member having an elongated body with a first end and a second end, a first portion formed at said first end, engageable to a part of said gas stove cooktop, a second portion formed at said second end, engageable to said venturi tube, wherein said mounting device is arranged to support said venturi tube from said cooktop in a cantilever manner during mounting of said venturi tube to said gas valve and said gas burner, and wherein said device comprises at least one C-shaped extension at one end for securely and supportingly engaging said cooktop and said second portion further comprises at least one support element adjacent a second end for snugly engaging said venturi tube.

18. A method of assembling a gas valve, venturi tube and gas burner in a stove having a cooktop with at least one gas burner controlled by the gas valve, said burner being supported above an oven cavity without a separate burner box comprising the steps of:

securing a first end of a support on said cooktop;

supporting said venturi tube at a second end of said support, such that said support supports said venturi tube in a cantilever manner during said assembly;

slip connecting a first end of said venturi tube to said gas valve; and securing a second end of said venturi tube to said burner.

19. The method according to claim 18 wherein said step of securing said first end of said support is further defined in that said first end engages a manifold pipe of said stove.

* * * * *

UNITED STATES PATENT AND TRADEMARK OFFICE

CERTIFICATE OF CORRECTION

PATENT NO. : 6,079,402

DATED : June 27, 2000

INVENTOR(S) : Thomas L. Gort, Carlos R. Tejada Medina, Timothy A. Bulcher

It is certified that error appears in the above-indentified patent and that said Letters Patent is hereby corrected as shown below:

Title page:

Item [73]

Assignee: Whirlpool Corporation, Benton Harbor, Mich. and Vitromatic Comercial S.A. de C.V., Monterrey, Mexico Signed and Sealed this First Day of May, 2001

Nicholas P. Godici

*Attest:*

NICHOLAS P. GODICI

*Attesting Officer*

*Acting Director of the United States Patent and Trademark Office*